US009010898B2

(12) United States Patent
Gerrits et al.

(10) Patent No.: US 9,010,898 B2
(45) Date of Patent: Apr. 21, 2015

(54) REPRODUCTION APPARATUS FOR PRINTING ON RECEIVING MATERIAL IN A SINGLE PASS PRINT STRATEGY

(71) Applicant: OCE-Technologies B.V., Venlo (NL)

(72) Inventors: Carolus E. P. Gerrits, Velden (NL); Sebastian P. R. C. De Smet, Venlo (NL); Alexander Lint, Veldhoven (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 14/159,696

(22) Filed: Jan. 21, 2014

(65) Prior Publication Data

US 2014/0139581 A1 May 22, 2014

Related U.S. Application Data

(63) Continuation of application No. PCT/EP2012/063095, filed on Jul. 5, 2012.

(30) Foreign Application Priority Data

Jul. 21, 2011 (EP) ..... 11174797

(51) Int. Cl.
*B41J 29/38* (2006.01)
*B41J 2/045* (2006.01)
*B41J 2/21* (2006.01)

(52) U.S. Cl.
CPC ..... *B41J 2/04501* (2013.01); *B41J 2/2139* (2013.01); *B41J 2/2142* (2013.01)

(58) Field of Classification Search
CPC ..... B41J 2/2132; B41J 2/2139; B41J 2/2142; B41J 2/0451
USPC ..... 347/12, 14, 15, 19
See application file for complete search history.

(56) References Cited

U.S. PATENT DOCUMENTS

| | | | | |
|---|---|---|---|---|
| 2004/0119766 | A1 * | 6/2004 | Shibata et al. | 347/12 |
| 2008/0174622 | A1 | 7/2008 | Carlson et al. | |
| 2010/0321431 | A1 | 12/2010 | Mori | |
| 2011/0074862 | A1 * | 3/2011 | Sasayama | 347/19 |
| 2011/0084995 | A1 | 4/2011 | Gothait et al. | |
| 2011/0084996 | A1 * | 4/2011 | Hirato et al. | 347/10 |
| 2011/0090276 | A1 * | 4/2011 | Hirano | 347/14 |
| 2012/0249640 | A1 * | 10/2012 | Ohnishi | 347/13 |

FOREIGN PATENT DOCUMENTS

EP 2 308 683 A1 4/2011

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

A reproduction apparatus for printing a digital image includes a control unit and a print engine. The digital image is constituted of pixels, each having assigned a pixel value. The print engine includes print elements for ejecting an amount of marking material on a receiving material according to a pixel value. The reproduction apparatus includes a detector for detecting a failing print element and the control unit includes a derivation unit for deriving, before printing of the digital image for a print element, at least one array of pixel values to be printed by at least one other print element, upon detection of a failing of the print element by the detector. A merging unit is configured to merge at least one of the at least one array of pixel values with the digital image, upon detection of a failing print element, for creating a corrected digital image.

9 Claims, 12 Drawing Sheets

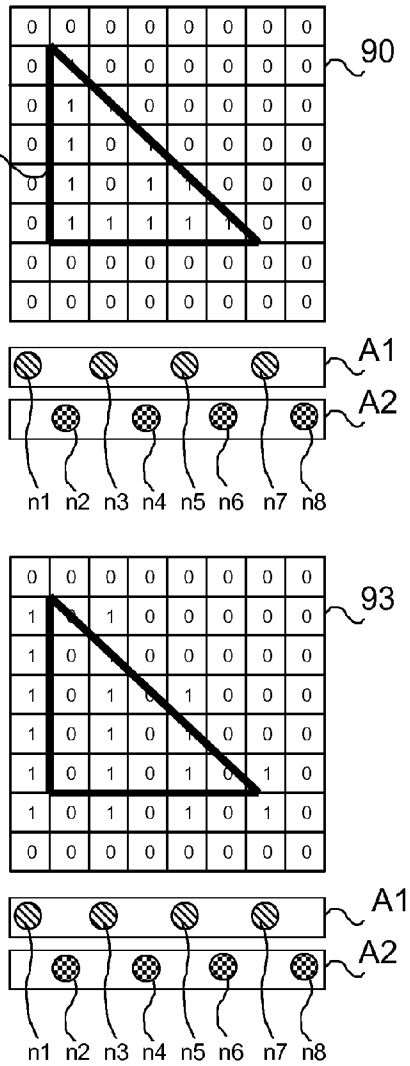
FIG. 9A
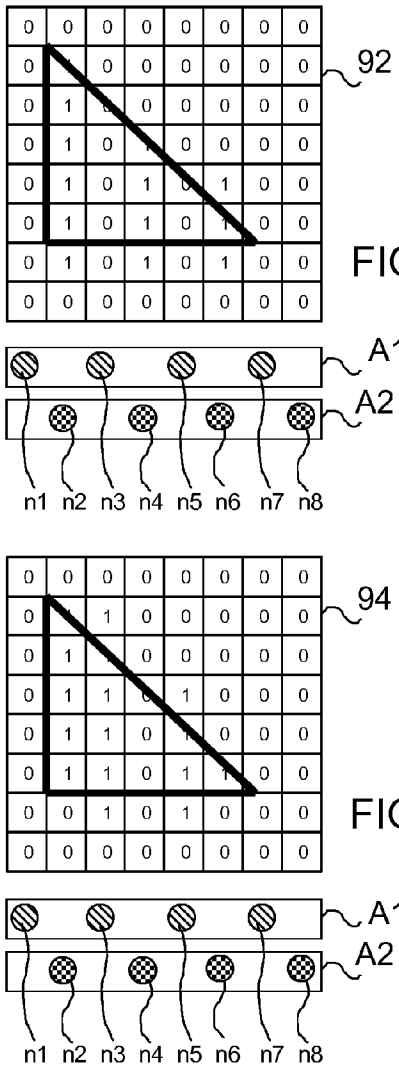
FIG. 9B
FIG. 9C
FIG. 9D
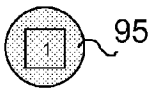
FIG. 9E

REPRODUCTION APPARATUS FOR PRINTING ON RECEIVING MATERIAL IN A SINGLE PASS PRINT STRATEGY

CROSS-REFERENCE TO RELATED APPLICATIONS

This application is a Continuation of International Application No. PCT/EP2012/063095, filed on Jul. 5, 2012, and for which priority is claimed under 35 U.S.C. §120. PCT/EP2012/063095 claims priority under 35 U.S.C. §119(a) to Application No. 11174797.8, filed in Europe on Jul. 21, 2011. The entire contents of each of the above-identified applications are hereby incorporated by reference into the present application.

BACKGROUND OF THE INVENTION

1. Field of the Invention

The present invention relates to a reproduction apparatus for printing a digital image comprising a control unit and a print engine, where the digital image is constituted of pixels, each pixel having assigned a pixel value; the print engine comprising print elements for ejecting an amount of marking material on a receiving material according to a pixel value, the reproduction apparatus further comprising a detector for detecting or predicting a failing print element.

2. Description of Background Art

Reproduction apparatuses are known which are able to print jobs arriving at the reproduction apparatus via a network or an analogue document via a scanner being part of the reproduction apparatus. Such a job may contain an image or a text or both an image and a text in black-and-white format or in color format. The job entry in the reproduction apparatus may be controlled by a controller, for example a computer, a control unit or a processor inside the reproduction apparatus. Also the controller may convert image and text data into commands for the print unit to let the print elements eject marking material at the right spot and the right time on the receiving material. The memory of the reproduction apparatus comprises a work memory part for loading and modifying images and a save memory for saving images.

However, print elements may fail when they become clogged or misdirecting.

Detectors are known, which can detect such a failing print element during printing or which can predict a high probability that a print element will fail within a short time. The visibility of a failing print element on the receiving material depends on the print strategy. In a multi-pass approach, a failing print element appears typically less visible than in a single pass approach. In a multi-pass approach each pixel line is addressed by multiple print elements and a failing print element may be compensated by filling in with another print element, for example in a later pass. However, such a print element failing correction for a multi-pass approach will not be possible in a single pass approach, where each pixel line is addressed by only one print element.

In a single pass approach, the failing print element immediately produces a light stripe in the print image on the receiving material and there is no chance to fill in this location later by means of another print element.

As soon as a failing print element is detected, while using a multi-pass strategy or a single pass strategy, other print elements than the failing print element might compensate for missing ejections of drops by the failing print element. Based on the information of the digital image to be printed, the locations on the receiving material to be printed upon by the failing print elements are determined and the correcting print data of the other print elements is determined during printing. A disadvantage is that during printing, a lot of image processing has to be done, which leads to a delay in correcting the failing print element. During this delay, the printing by the reproduction apparatus goes on, resulting in printed images with print artifacts due to the failing print element. This leads also to a loss of productivity of the reproduction apparatus.

SUMMARY OF THE INVENTION

It is an object of the present invention to provide a reproduction apparatus, which needs much less image processing time when a failing print element is detected or predicted during printing of a digital image.

According to the present invention, this object is achieved by a reproduction apparatus, wherein the control unit comprises a derivation unit configured to derive from the digital image, before printing of the digital image for a print element, at least one array of pixel values to be printed by at least one other print element, upon detection of a failing of said print element by the detector; and a merging unit configured to merge at least one of said at least one array of pixel values with the digital image, upon detection of said failing print element, for creating a corrected digital image to be printed.

The derivation unit according to the present invention is able to derive from the digital image, in advance of printing the digital image, arrays of pixel values. An array of pixel values is meant to replace a column of the digital image in case of a failing print element. The arrays of pixel values are constructed in such a way that, for each print element which is failing, arrays of pixels are available. A column of the image may not be printed on the receiving material because the corresponding print element is failing. In that case, at least one other column in the image is replaced by at least one derived array of pixel values.

It should be noted that only the digital image is loaded completely. A derived array of pixel values is only loaded when required due to a failing print element. Since usually only a limited number of print elements of a print head simultaneously fail, an extra bandwidth of memory required for retrieving the alternative arrays from the memory of the control unit is very low. This means that the time spent during printing or merging the appropriate pixel arrays derived before the start of printing of the image with the original digital image is much lower than a calculation of these arrays at the moment during printing that a failing print element is detected.

According to an embodiment of the reproduction apparatus, the at least one other print element is a compensating print element of the failing print element. A compensating print element of the failing print element is a print element, which is able to eject a drop on substantially the same location on the receiving material where the failing print element intended to eject a drop. Such a compensation print element may be an adjacent print element of the failing print element. An adjacent print element is a print element, which is positioned on a print head of the reproduction apparatus directly beside the failing print element. When the print elements are arranged in an array, the adjacent print element may be a left or a right neighboring print element in the array. The reproduction apparatus may comprise, besides adjacent print elements, redundant print elements. A redundant print element is able to print on a same position on the receiving material as another print element without an extra movement of the print elements. Such a redundant print element is usually positioned in a second array of print elements on the same print head, or on a second print head positioned parallel to a first print head, each print head containing at least one array of print elements. The present invention is in particular applicable to a reproduction apparatus, which does not have redundant print elements.

A print element adjacent to the failing print element is suitable for ejecting a part of the amount of marking material, which was intended to be ejected by the failing print element. When the failing print element has more than one adjacent print element, the amount of marking material intended to be ejected by the failing print element may be distributed among the more than one adjacent print element. In another embodiment, a compensating element is not adjacent to the failing print element, but in an array of print elements, which does not contain the failing print element. The position of such a compensating print element in the array is suitable to compensate the failing print element, which is for example positioned in another array of print elements.

According to an embodiment of the reproduction apparatus, the derivation unit is configured to derive the at least one array of pixel values for each print element intended to be used for printing the image. For a print element, which is not used for printing the image, an array of pixels need not be derived. Also a pixel line to be printed by a print element may contain no information. In that case, a derivation of an array of pixels is not necessary. However, to simplify the derivation of the arrays of pixels, according to another embodiment, the derivation unit may not distinguish the print elements, which are intended to print the image from the print elements that are not intended to print the image, but may derive arrays of pixels for each print element.

According to an embodiment of the reproduction apparatus, the at least one array of pixel values to be printed by the at least one other print element are arranged as columns in at least one matrix of pixel values. An array of pixel values to be printed by a same print element may be arranged as a column in a matrix of pixel values. This is advantageous since in this way an array of pixel values is easily extractable from the matrix by elementary matrix operations. Moreover, in case of arrays of pixel values to be printed by more than one other print element, the arrays may be arranged as columns in one matrix of pixel values. This is advantageous, since there is only one matrix to be derived. An array of pixel values is easily extractable from the single matrix by elementary matrix operations.

According to an embodiment based on the previous embodiment, the at least one matrix is redundant with respect to the digital image at a lower resolution than the digital image, said resolution being determined to have an overlap of adjacent drops, which overlap is sufficient to reach a full coverage in case of printing a solid on the receiving material. The marking material may be a solidifying material for example for printing solid features. The matrix comprises the digital information of the original digital image at a lower resolution. The reproduction apparatus may be configured to let print elements adjacent to a failing print element eject drops according to the matrix with the lower resolution on positions adjacent to positions intended to be printed by a failing print element. Due to the lower resolution with the sufficient overlap, it is assured that critical image elements are fully covered. This is especially advantageous when printing masks for manufacturing solar cells, lighting devices or electronic devices. Masks for such cells and devices comprise printed image elements, also known as features, which are expected to have a conducting or isolating property.

According to an embodiment, the reproduction apparatus comprises a halftoning mechanism for halftoning the digital image after derivation of the at least one array of pixel values from the digital image by the derivation unit. Since the halftoning step is after the derivation of the at least one array of pixel values, the at least one array of pixel values consist of gray levels. Therefore the deriving unit acts on a large range of values for derivation of and tuning of the at least one array of pixel values.

According to an embodiment, the reproduction apparatus comprises a halftoning mechanism for halftoning the digital image before derivation of the at least one array of pixel values from the digital image by the derivation unit. Since the halftoning step is before the derivation of the at least one array based on the digital image, the derivation unit and merging unit operate upon halftoned values and may use a simple mathematical operation on the halftoned values of the at least one alternative array to be replaced.

The present invention also relates to a method for printing a digital image by a reproduction apparatus comprising a print engine that comprises print elements, where the digital image is constituted of pixels, each pixel having assigned a pixel value, the method comprising the steps of deriving from the digital image, before printing of the digital image for a print element, an array of pixel values to be printed by at least one other print element, upon detection of a failing of said print element; and upon detection of a failing print element before or during printing, merging at least one of said arrays of pixel values with the digital image for creating a corrected digital image, and printing the corrected digital image.

The present invention is also directed to a computer program embodied on a non-transitory computer readable medium and comprising computer program code to enable the reproduction apparatus according to claim 1 to execute a method for printing a digital image, the method comprising the steps of: deriving from the digital image, before printing of the digital image for a print element, an array of pixel values to be printed by at least one other print element, upon detection of a failing of said print element; and upon detection of a failing print element before or during printing, merging at least one of said arrays of pixel values with the digital image for creating a corrected digital image, and printing the corrected digital image.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 9A-9E show another embodiment of the method according to the present invention.

DETAILED DESCRIPTION OF THE PREFERRED EMBODIMENTS

Figure 1A:
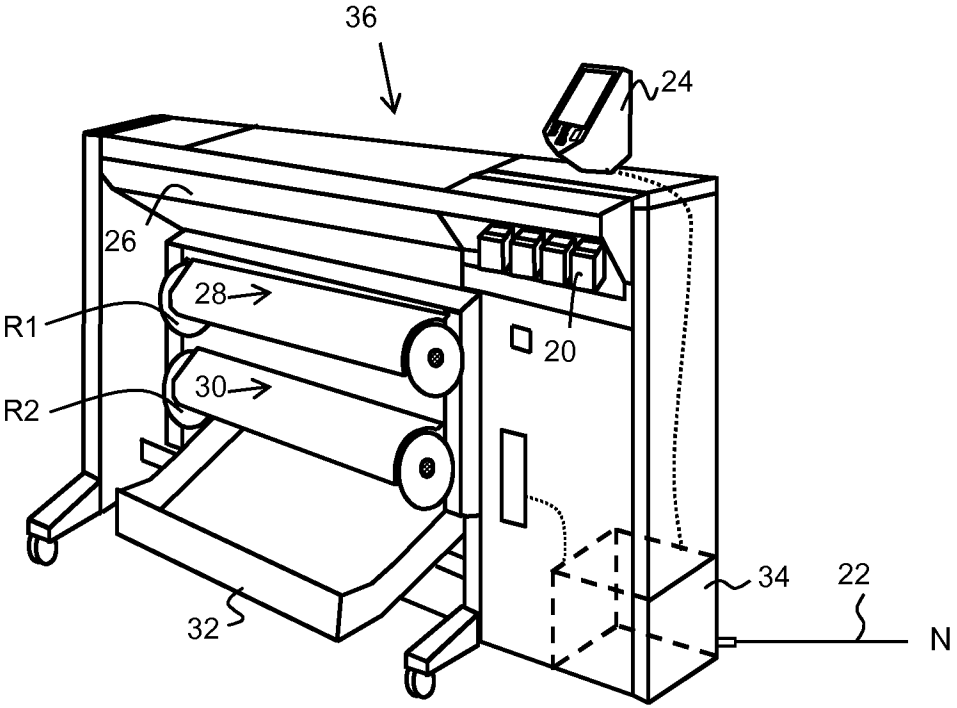
FIG. 1A shows a reproduction apparatus to which the invention is applicable.
Figure 1B:
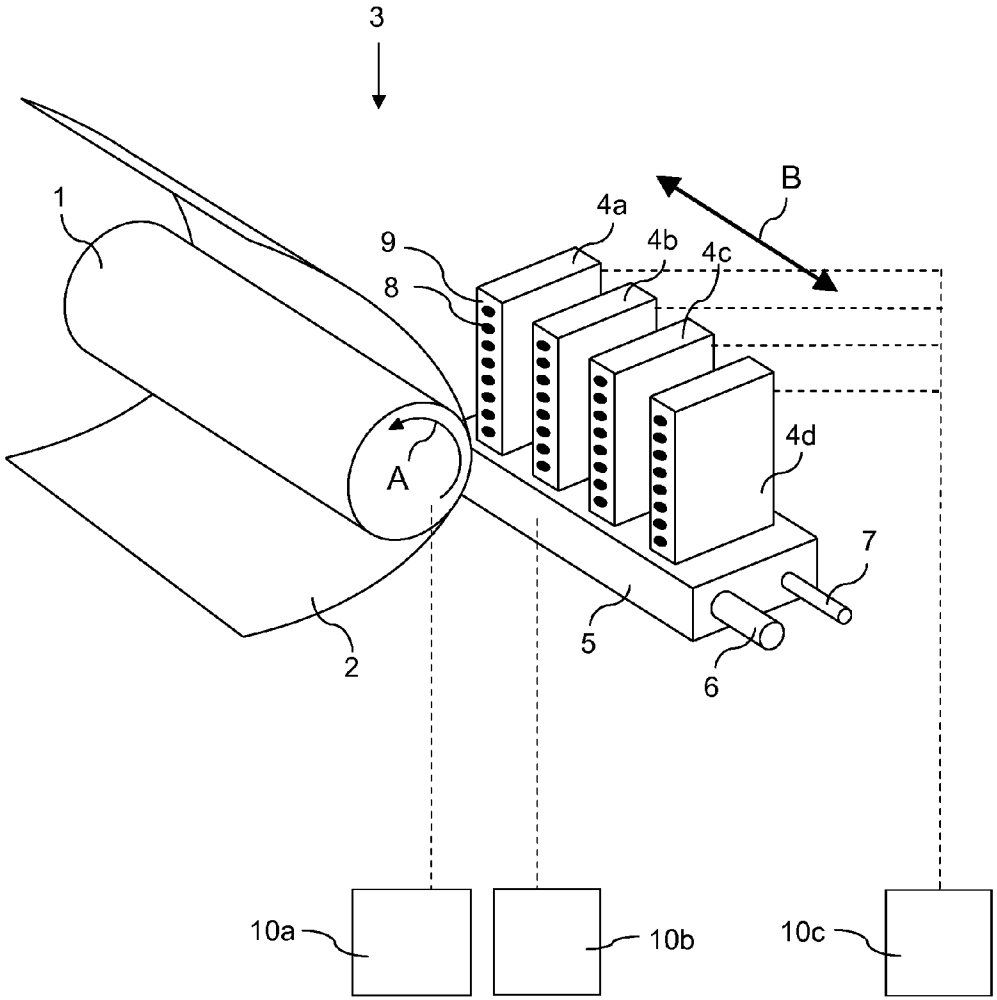
FIG. 1B shows an ink jet printing assembly to be placed in the reproduction apparatus of FIG. 1A.

FIG. 1A shows a reproduction apparatus 36, wherein printing is achieved using a wide format inkjet printer. The wide-format image forming apparatus 36 comprises a housing 26, wherein the printing assembly, for example the ink jet printing assembly shown in FIG. 1B, is placed. The reproduction apparatus 36 also comprises a storage device configured to store image receiving member 28, 30, a delivery station to collect the image receiving member 28, 30 after printing and a storage device configured to store marking material 20. In FIG. 1A, the delivery station is embodied as a delivery tray 32. Optionally, the delivery station may comprise processing device configured to process the image receiving member 28, 30 after printing, e.g. a folder or a puncher. The wide-format image forming apparatus 36 furthermore comprises a device for receiving print jobs and optionally a device for manipulating print jobs. These devices may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with respective print heads for supplying marking material to said print heads (shown in FIG. 1B).

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. In another embodiment the local user interface unit 24 may comprise a selector for activating the quality mode as described in an embodiment of the method here-above.

The control unit 34, for example a computer, comprises a processor adapted to issue commands to the print engine, for example for controlling the print process. The reproduction apparatus 36 may optionally be connected to a network N. The connection to the network N is diagrammatically shown in the form of a cable 22, but nevertheless, the connection could be wireless. The reproduction apparatus 36 may receive printing jobs via the network. Further, optionally, the controller of the printer may be provided with a USB port, so print jobs may be sent to the printer via this USB port. The control unit 34 may also be configured to automatically decide whether or not a quality mode is activated when printing an image. The control unit 34 also comprises the derivation unit and merging unit according to the present invention.

FIG. 1B shows an ink jet printing assembly 3. The ink jet printing assembly 3 comprises a support for supporting an image receiving member 2. The support is shown in FIG. 1B as a platen 1, but alternatively, the support may be a flat surface. The platen 1, as depicted in FIG. 1B, is a rotatable drum, which is rotatable about its axis as indicated by arrow A. The support may be optionally provided with suction holes for holding the image receiving member in a fixed position with respect to the support. The ink jet printing assembly 3 comprises print heads 4*a*-4*d*, mounted on a scanning print carriage 5. The scanning print carriage 5 is guided by suitable guides 6, 7 reciprocate in the main scanning direction B. Each print head 4*a*, 4*b*, 4*c*, 4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controls 10*a*, 10*b* and 10*c*, respectively. A detector for detecting failing print elements may be integrated at the print heads 4*a*-4*d*, or may be mounted on the carriage 5 as a scanner, which is configured to scan the just ejected marking material dots.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may reciprocate in the main scanning direction B parallel to the platen 1, such as to enable scanning of the image receiving member 2 in the main scanning direction B. Only four print heads 4*a*-4*d* are depicted for demonstrating the present invention. In practice an arbitrary number of print heads may be employed. In any case, at least one print head 4*a*, 4*b*, 4*c*, 4*d* per color of marking material is placed on the scanning print carriage 5. For example, for a black-and-white printer, at least one print head 4*a*, 4*b*, 4*c*, 4*d*, usually containing black marking material is present. Alternatively, a black-and-white printer may comprise a white marking material, which is to be applied on a black image-receiving member 2. For a full-color printer, containing multiple colors, at least one print head 4*a*, 4*b*, 4*c*, 4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*, 4*b*, 4*c*, 4*d* containing black marking material may be larger than any of the print heads 4*a*-4*d*, containing a differently colored marking material.

The carriage 5 is guided by guides 6, 7. These guides 6, 7 may be rods as depicted in FIG. 1B. The rods may be driven by suitable drives (not shown). Alternatively, the carriage 5 may be guided by other guides, such as an arm being able to move the carriage 5. Another alternative is to move the image receiving material 2 in the main scanning direction B.

The apparatus may also be embodied with a non-scanning page-wide print carriage 5. The receiving material is moving under the print carriage 5, while the print carriage 5 is not moved in any direction. Such an apparatus usually applies a single pass strategy. Since the print carriage 5 is page-wide, on every image scan-line in the direction of the movement of the receiving material marking material is ejected by at least one print element.

Each print head 4*a*,4*b*,4*c*,4*d* comprises an orifice surface 9 having at least one orifice 8, in fluid communication with a pressure chamber containing fluid marking material provided in the print head 4*a*,4*b*,4*c*,4*d*. On the orifice surface 9, a number of orifices 8 is arranged in a single linear array parallel to the sub-scanning direction A. Eight orifices 8 per print head 4*a*, 4*b*, 4*c*, 4*d* are depicted in FIG. 1B, however obviously in a practical embodiment several hundreds of orifices 8 may be provided per print head 4*a*, 4*b*, 4*c*, 4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*, 4*b*, 4*c*, 4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8. Each of the orifices 8, except an orifice at an end of the inkjet printing assembly, has a left neighbor in the main scanning direction and a right neighbor in the main scanning direction. The left and right neighbor may be invoked when the orifice in between them is failing.

Upon ejection of the marking material, some marking material may be spilled and stay on the orifice surface 9 of the print head 4*a*, 4*b*, 4*c*, 4*d*. The ink present on the orifice surface 9 may negatively influence the ejection of droplets and the placement of these droplets on the image receiving member 2. Therefore, it may be advantageous to remove excess ink from the orifice surface 9. The excess ink may be removed for example by wiping with a wiper and/or by application of a suitable anti-wetting property of the surface, e.g. provided by a coating.

The reproduction apparatus may be an inkjet printer according to FIG. 1A comprising a print head according to FIG. 1B. A marking material may be a UV curable ink. The receiving medium may be paper, corrugated plastic such as coroplast, plastic sheets such as Gatorplast®, polycarbonate, scrim banner, or polystyrene (even black polystyrene).

Figure 2A:
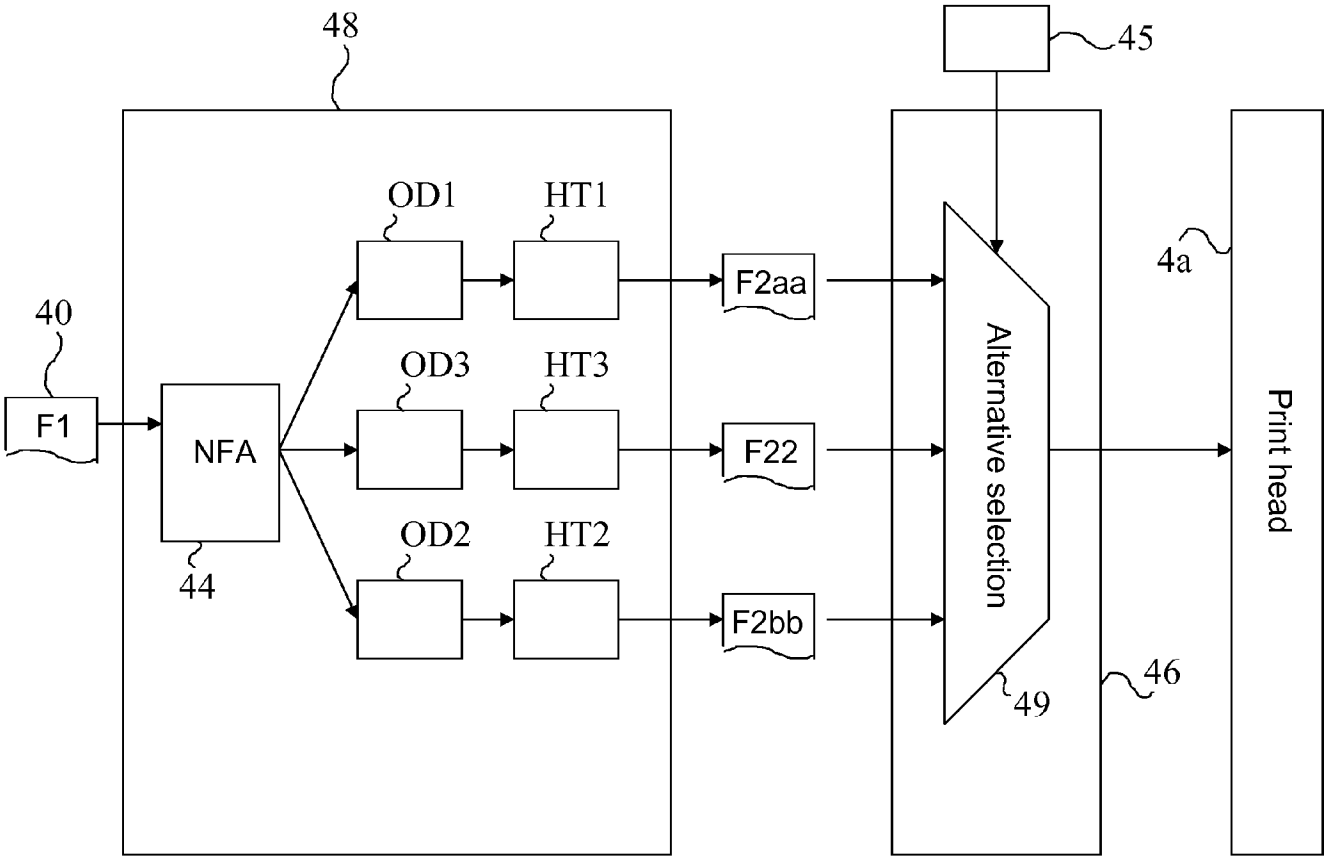
FIGS. 2A-2B show schematically flow diagrams of a method for printing a digital image on a receiving material by the reproduction apparatus according to the present invention.

FIG. 2A shows schematically a flow diagram of a method for printing a digital image on a receiving material by the reproduction apparatus according to the present invention. The method is described in a plurality of steps by components for one digital image F1 which has arrived at the reproduction apparatus, but may also be applied for a plurality of subsequent digital images by repeating the plurality of steps. This is one embodiment of the method, but variations may be applied according to the several embodiments of the reproduction apparatus. Each of the steps may be executed by a corresponding component. FIG. 2A shows a schematic image processing path 48, which contains nozzle failure analysis component 44, optical density correction components OD1, OD2, OD3 for calibrating a digital image to the optical density for each color plane and halftoning components HT1, HT2, HT3 for halftoning a digital image. The derivation unit according to an embodiment of the present invention at least comprises the nozzle failure analysis component 44 and may also comprise the optical density correction components and the halftoning components.

The optical density correction components OD1, OD2, OD3 may be combined into one optical density correction component. The optical density correction components OD1, OD2, OD3 may also be omitted from the image processing path 48. The halftoning components HT1, HT2, HT3 may be combined into one halftoning component. In practice the image processing path 48 may be organized in a different way. For simplicity it is assumed that there are no inter-plane dependencies between color planes C, M, Y, K in the reproduction apparatus. For this case, FIG. 2A gives an example of a single image plane, either C, M, Y or K. To reach a full color implementation, the steps executed by the components of FIG. 2A have to be repeated as many times as there are different color planes. Dependencies may be present in the halftoning step executed by the halftoning components HT1, HT2, HT3 or in a compression format used to store the digital images. The halftoning components are configured to apply multi-level halftoning.

FIG. 2A also shows a schematic print data path 46 containing an alternative selection component 49. The print data path 46 gets failing nozzle information from a nozzle failing detection component 45 and outputs a data stream to the print head 4*a* in order to print a digital matrix being output from the alternative selection component 49. The same image processing path 48 and print data path 46 are configured for serving the remaining print heads 4*b*, 4*c*, 4*d*. The merging unit according to an embodiment of the present invention at least comprises the alternative selection component 49 and the nozzle failing detection component 45.

The starting point 40 is the digital image F1 arriving at the reproduction apparatus via the network N and saved in a memory of the reproduction apparatus.

In a first step, the digital image is analyzed for what to do in case of failure of each of the print elements. Hereinafter, the print element will be called a nozzle, but may also read as any other kind of print element. A nozzle failure analyzing step NFA is applied by the nozzle failure analysis component 44 to the digital image F1. The nozzle failure analyzing step NFA results in three digital matrices.

Each of the three digital matrices has a plurality of columns of pixel values. Each column of pixel values may be used to print a column of pixels on the receiving material by a single nozzle. The nozzle failure analyzing step NFA will be explained with reference to FIG. 3 below.

A first digital matrix is transferred to a first optical density correction component OD1 for calibrating the matrix to optical density corrected values. For measuring the optical density, a well-known technique may be used and will not be elaborated upon. From the first optical density correction component OD1, the resulting matrix is guided to a first halftoning component HT1 for halftoning the matrix.

A second digital matrix is transferred to a second optical density correction component OD2 for calibrating the matrix to optical density corrected values. From the second optical density correction component OD2, the resulting matrix is guided to a second halftoning component HT2 for halftoning the matrix.

A third digital matrix is transferred to a third optical density correction component OD3 for calibrating the matrix to optical density corrected values. From the third optical density correction component OD3, the resulting matrix is guided to a third halftoning component HT3 for halftoning the matrix.

The first halftoning component HT1 delivers a first halftoned digital matrix F2*aa*. The second halftoning component HT2 delivers a second halftoned digital matrix F2*bb*. The third halftoning component HT3 delivers a third halftoned digital image F22, which is the halftoned optical density calibrated image of the original digital image F1.

The three halftoned digital matrices F2*aa*, F22, F2*bb* are input for the alternative selection unit 49. A nozzle failure detection component 45 delivers failing nozzle information to the alternative selection unit 49. The failing nozzle information may comprise a list of nozzles, each of which is failing, to deliver marking material on the receiving material. The failing nozzle information is used to construct from the three digital matrices F2*aa*, F22, F2*bb* a matrix, which is input for the print head 4*a*. The third halftoned digital image F22 is adapted by means of the other halftoned digital matrices F2*aa*, F2*bb* in such a way that the failing nozzle information is taken into account.

Figure 3:
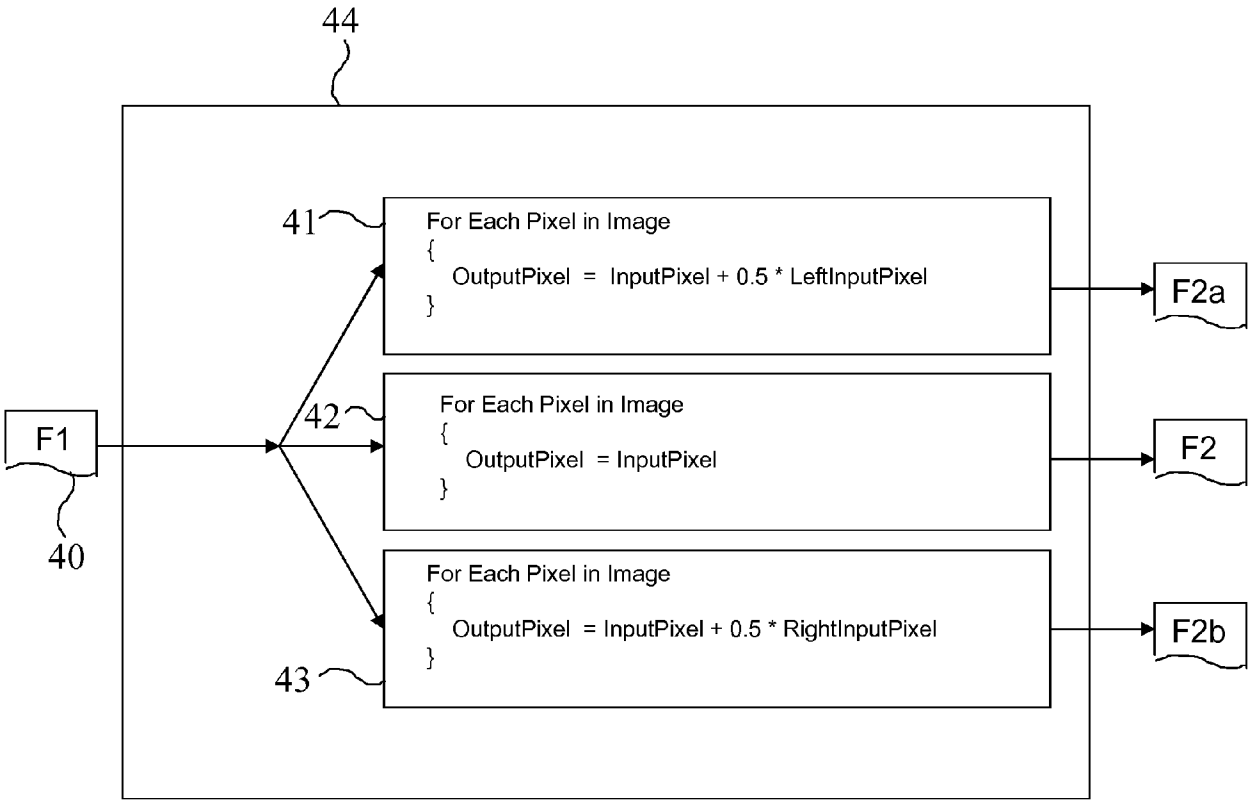
FIG. 3 shows schematically a diagram of a derivation of additional digital matrices in advance to printing for nozzle failure correction.

FIG. 3 shows an embodiment of the analyzing step NFA as already shown in FIG. 2A in more detail. According to this embodiment, the analyzing step NFA precedes the halftoning steps and operates upon gray level values. The original image F1 is an input image 40 for the nozzle failure analysis component 44. Three processes 41, 42, 43 are applied to the pixels of the input image 40 resulting in three output matrices F2*a*, F2, F2*b*, which are saved in the memory of the reproduction apparatus. The additional output matrices F2*a*, F2*b* comprise columns of pixel values, such that each pixel value, except the pixel values in the uttermost left column, have a left adjacent pixel value, and each pixel value, except the pixel values in the uppermost right column, have a right adjacent pixel value.

The first output matrix F2*a* is a first additional digital matrix, which is constructed in the following manner: Each entry in the digital image F1 having an input pixel value gets an output pixel value, which equals the input pixel value incremented with a weight value. The weight value is, in this implementation, half the value of an input pixel left from the entry in the digital image F1.

The second output matrix F2*b* is a second additional digital matrix, which is constructed in the following manner: Each entry in the digital image F1 having an input pixel value gets an output pixel value, which equals the input pixel value incremented with a weight value. The weight value is, in this implementation, half the value of an input pixel right from the entry in the digital image F1.

The third output matrix F2 is equal to the input image F1.

It is noted that the construction of the first additional output matrix F2*a* and the second additional output matrix F2*b* may be implemented otherwise, for example with different weights, with weights dependent on the input pixel values, or by incorporating values of other pixels in the processes 41, 42, 43 than the two neighboring—left and right—pixels per pixel in the output matrix F2.

In an alternative embodiment, the first output matrix F2*a* and the second output matrix F2*b* are implemented by entries, which represent the adding values to the output of the original left and right neighboring columns. This means that these adding values are added to the original entries of these columns when a nozzle is failing, instead of replacing these columns as in the previous embodiment. This is advantageous, since in this way also a column of entries to be printed by a nozzle of which both neighboring nozzles fail, may correctly compensate both neighboring columns.

Left and right positions of the entries are meant in a direction perpendicular to the direction of a pixel column to be printed on the receiving material by a nozzle. This direction is corresponding to a direction perpendicular to the length direction of a column of the pixel values in the additional digital output matrices F2*a*, F2*b*.

The three digital output matrices F2*a*, F2, F2*b* as shown in FIG. 3, are further processed via optical density correction components OD1, OD2, OD3 and via halftoning components HT1, HT2, HT3 as shown in FIG. 2 resulting in three digital matrices F2*aa*, F22, F2*bb* before they reach the alternative selection unit 49 in the print data path 46 of the reproduction apparatus.

Figure 2B:
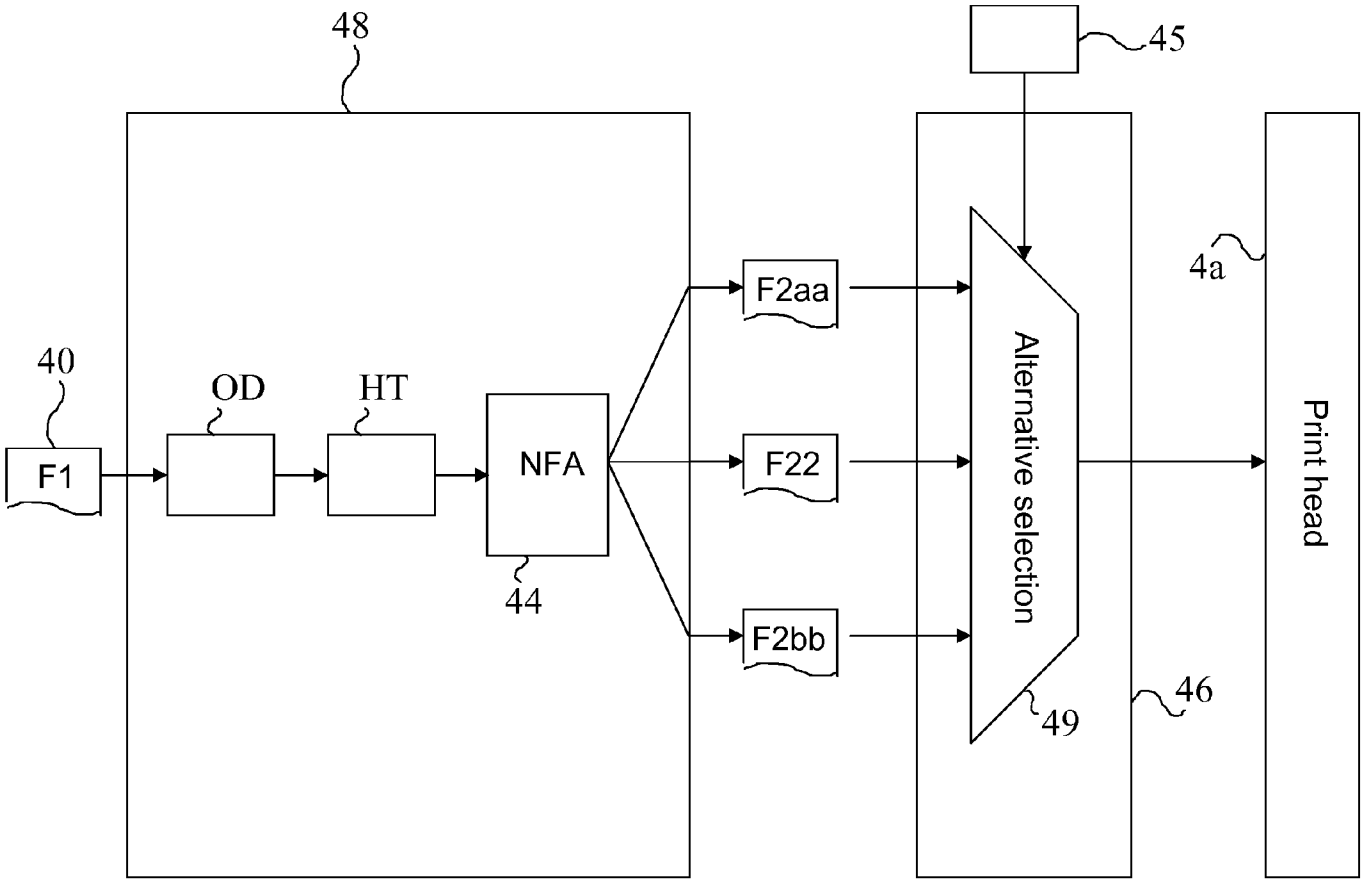

FIG. 2B shows an alternative embodiment, wherein the input image 40 is transferred to an optical density correction component OD and a halftoning component HT before reaching the nozzle failure analyzing step NFA. In such an embodiment, the nozzle failure analyzing step NFA is operating on halftone levels instead of grey level values.

In either embodiment shown in FIG. 2A-2B, two lookup tables may be used for determining the output pixel values in the digital matrices F2*aa*, F22, F2*bb*.

In a first lookup table, the input pixel value of the pixel under investigation and the value of the input pixel left from the pixel under investigation are implemented as an index for looking up the output pixel value. In a second lookup table, the input pixel value of the pixel under investigation and the value of the input pixel right from the pixel under investigation are implemented as an index for looking up the output pixel value.

Since the number of halftone levels is discrete and related to discrete sizes of marking material drops—for example a zero value for no drop, a one value for a small drop or a two value for a large drop of marking material to be ejected—only big compensation steps (from one halftone level to another) may be made for a pixel. To gain an appropriate compensation for print artifacts, either any kind of local error diffusion scheme may be used, or an additional counter may be used as an index for the lookup tables in order to create a pattern dithering effect and generate a sequence of halftone levels to approximate a desired compensation level. Such a lookup table may differ per receiving material and may be filled and calibrated or tuned by hand to produce optimal results.

Figure 4:
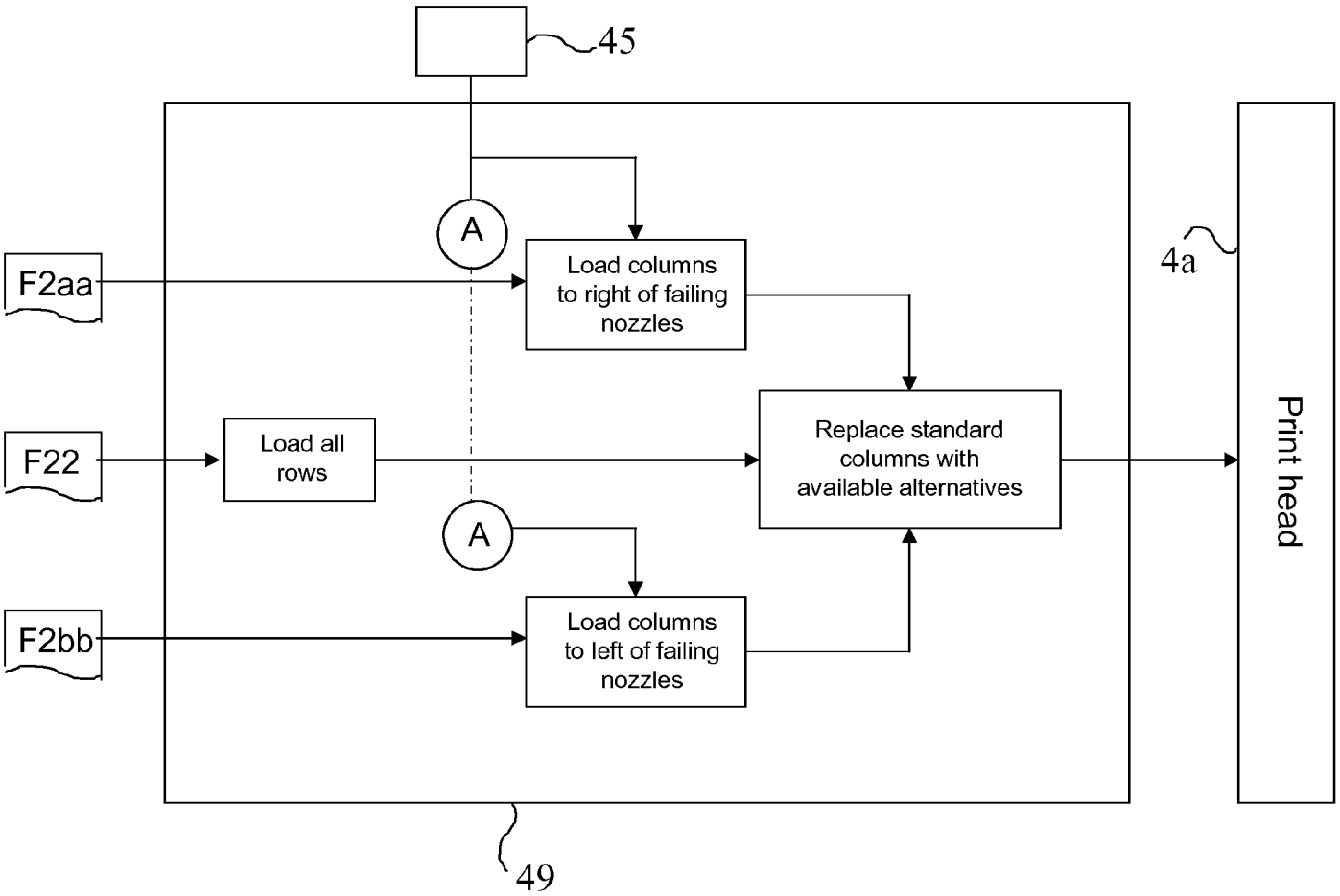
FIG. 4 shows schematically a diagram of a method for merging a digital matrix with the two additional matrices achieved from the preventive nozzle failure correction shown in FIG. 3.

FIG. 4 shows an embodiment of an alternative selection step by the alternative selection unit 49 in more detail. The three digital matrices F2*aa*, F22, F2*bb* are the input for the alternative selection unit 49. The alternative selection unit 49 is going to determine which columns of the three digital matrices F2*aa*, F22, F2*bb* are going to be used for constructing a digital matrix, which is going to be printed on the receiving material.

All columns of the digital matrix F22 are loaded into the memory of the reproduction apparatus. These columns are derived from the columns of the original image F1. Failing nozzle information from the failing nozzle detection component 45 is also input for the alternative selection means 49. Thus, the alternative selection unit 49 has knowledge of the nozzles that are failing, after failing nozzle information is transferred from the failing nozzle detection component 45 to the alternative selection unit 49.

The failing nozzle information may comprise for each nozzle a nozzle status and an array of failing nozzles. The nozzle status for a nozzle may be encoded in natural numbers 0, 1, 2, 3, etc.

In an embodiment, only the numbers 0 and 1 are used to indicate whether the nozzle is failing or not. This is advantageous, since only one bit of information per nozzle is needed.

In an alternative embodiment, the numbers 0, 1, 2 and 3 are used.

A number 0 for a nozzle may indicate that the nozzle is in a good condition, the left adjacent nozzle is in a good condition and the right adjacent nozzle is in a good condition. A nozzle with a code 0 is going to print the corresponding column of the digital matrix F22.

A number 1 for a nozzle may indicate that the nozzle is in a good condition, but the left adjacent nozzle is failing. A nozzle with a code 1 is going to print a corresponding column of the digital matrix F2*aa*.

A number 2 for a nozzle may indicate that the nozzle is in a good condition, but the right adjacent nozzle is failing. A nozzle with a code 2 is going to print a corresponding column of the digital matrix F2*bb*.

A number 3 for a nozzle may indicate that the nozzle is failing. The column intended to be printed by the failing nozzle, will be cleared in the matrix to be printed by the print head.

Such a coding is advantageous, since the code of a nozzle, in particular one of the codes 1 and 2, immediately determines from which digital matrix F2*aa*, F2*bb* the column corresponding to the nozzle is to be loaded into memory for merging into the resulting matrix to be printed by the print head.

When at least one failing nozzle is detected, the following steps are provided.

From the first additional digital matrix F2*aa*, only those columns are loaded into the memory which are to be printed by a nozzle that is positioned right from a failing nozzle on the print head 4*a*. Note that the print head 4*a* is mentioned here for the elucidation of the present invention, but any other print head 4*b*, 4*c*, 4*d* may have been mentioned.

From the second additional digital matrix F2*bb*, only those columns are loaded into the memory which are to be printed by a nozzle that is positioned left from a failing nozzle on the print head 4*a*.

Left and right positions are meant in a direction perpendicular to the direction of pixel columns to be printed on the receiving material by the nozzles.

In a final step in the alternative selection unit 49, the columns in the digital image F22 that are deemed to be printed by the nozzles left and right positioned from a failing nozzle are replaced by a column loaded from the first additional digital matrix F2*aa*, respectively by a column loaded from the second additional digital matrix F2*bb*. The resulting output matrix is transferred to the print head 4*a* in order to be printed.

When no failing nozzle is detected, no columns are loaded from the two additional digital matrices F2*aa*, F2*bb*. The digital image F22 is just the output matrix from the alternative selection unit 49. In this case, the output matrix is derived from the original image F1 only. The output matrix is transferred to the print head 4*a* in order to be printed.

Figure 5:
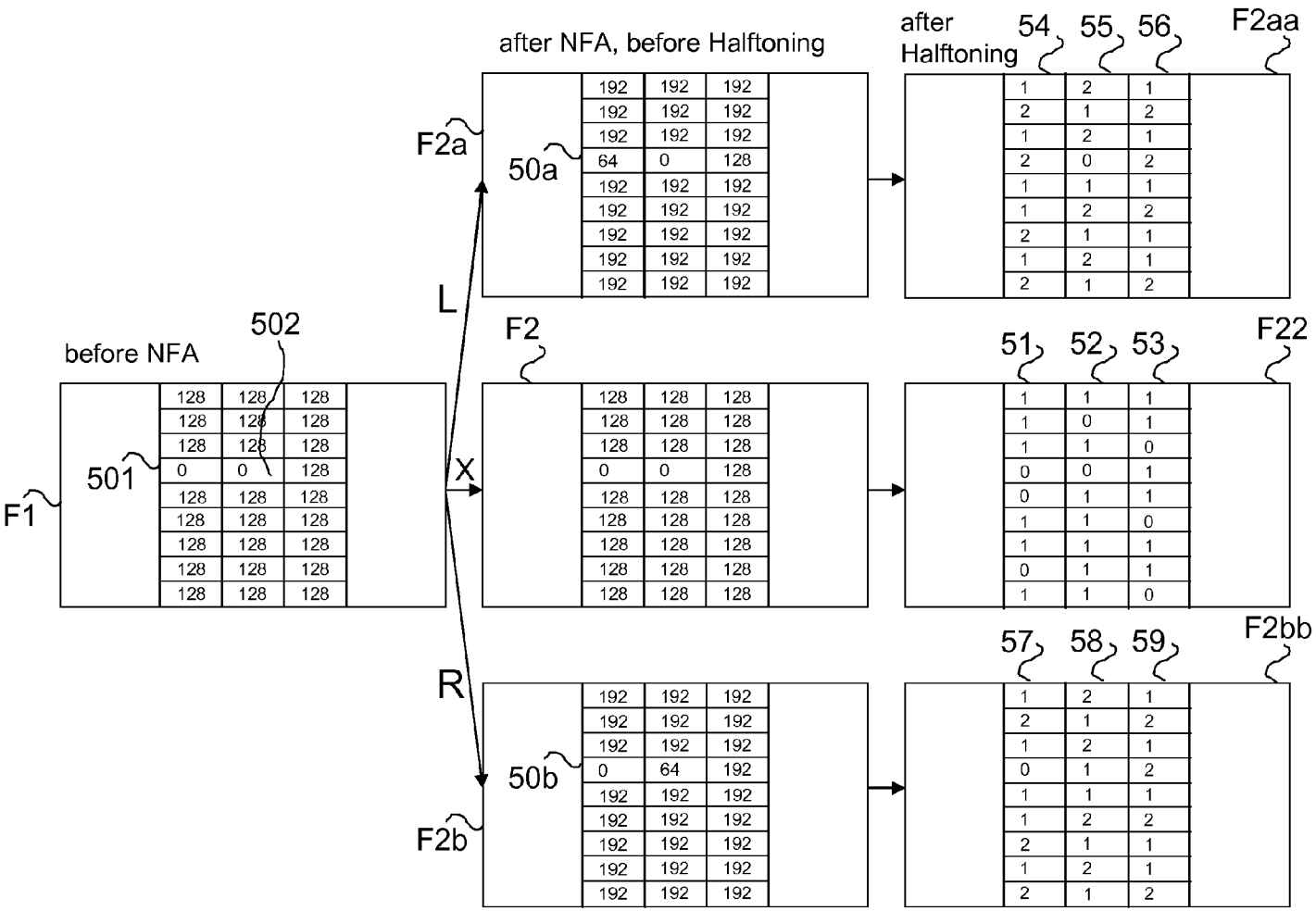
FIG. 5 shows image data during the steps executed by the derivation unit according to the present invention, when a nozzle failure analysis precedes a halftoning step.

FIG. 5 shows an example of entry values for the image matrices F1, F2, F2*a*, F2*b*, F22, F2*aa*, F2*bb*. In the shown embodiment, the nozzle failure analyzing step NFA precedes the halftoning steps HT1, HT2, HT3. In the shown embodiment, the optical density steps realized by the optical density correction components OD1, OD2, OD3 are omitted. This may be achieved by omitting the optical density correction components OD1, OD2, OD3 themselves from the image processing path. For convenience reasons, only a part of the image data F1 and corresponding parts of the other digital matrices F2, F2*a*, F2*b*, F22, F2*aa*, F2*bb* are shown, namely three columns of pixels. Each pixel of the three columns of original image F1 has a grey value of 128, except two pixels 501, 502 have a grey value of 0.

The halftoning steps shown are multi-level halftoning steps delivering values 0, 1 and 2 for respectively no drop, a small drop and a large drop of marking material. A binary halftoning process may also be applied.

The nozzle failure analyzing step NFA is applied and delivers the three digital matrices F2, F2*a*, F2*b*.

A first arrow indicated by L leads to the correcting values in the three columns in the first additional digital matrix F2*a*. The shown entries of the first additional digital matrix F2*a* have a grey value of 192, which is the sum of 128, being the original grey value of each of the pixels of the original matrix F1 incremented with 0.5*128=64, being the half of the original grey value of a left neighboring pixel in the original matrix F1, except entries in a row 50*a* having deviating grey values 64, 0, 128, respectively.

On the first additional digital matrix F2*a*, the first halftoning step HT1 is applied. From the first halftoning step HT1, a digital matrix F2*aa* is outputted, having three columns 54, 55, 56 comprising halftone values 0, 1 and 2.

A second arrow indicated by R leads to the corrected values in three columns in the second additional digital matrix F2*b*. The shown entries of the second additional digital matrix F2*b* have a grey value of 192, which is the sum of 128, being the original grey value of each of the pixels of the original matrix F1 incremented with 0.5*128=64, being the half of the original grey value of a right neighboring pixel in the original matrix F1, except entries in a row 50*b* having deviating grey values 0, 64, 192, respectively.

On the second additional digital matrix F2*b*, the second halftoning step HT2 is applied. From the second halftoning step HT2, a digital matrix F2*bb* is outputted, having three columns 57, 58, 59 comprising halftone values 0, 1 and 2.

A third arrow indicated by X leads to the original values of F1 being copied into the third digital matrix F2. On the original digital matrix F1, the third halftoning step HT3 is applied. From the third halftoning step HT3, a digital matrix F22 is outputted, having three columns 51, 52, 53 comprising halftone values 0 and 1.

Figure 6:
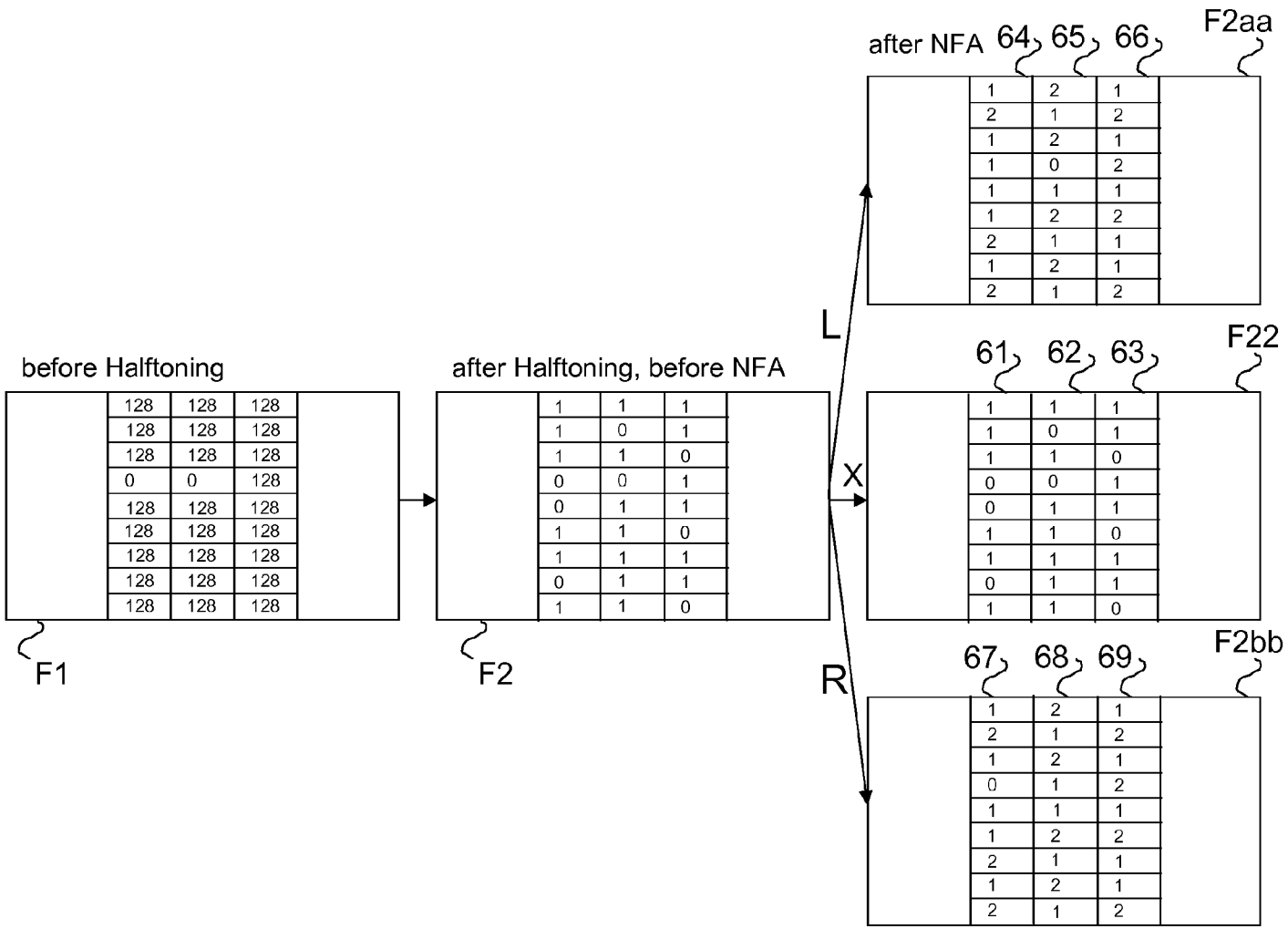
FIG. 6 shows image data during the steps executed by the derivation unit according to the present invention, when a nozzle failure analysis follows a halftoning step.

FIG. 6 shows entry values for the image matrices F1, F2, F22, F2*aa*, F2*bb*. In contrast with the embodiment shown in FIG. 5, according to the embodiment shown in FIG. 6, the nozzle failure analyzing step NFA follows the third halftoning step HT (See FIG. 2B). For convenience reasons, only a part of the image data F1 and corresponding parts of the other digital matrices F2, F22, F2*aa*, F2*bb* are shown, namely three columns of pixels. Each pixel of the three columns of original image F1 has a grey value of 128, except pixels in the fourth row of original image F1.

The halftoning step shown is a halftoning step delivering values 0, 1 for respectively no drop and a small drop of marking material. A multi-level halftoning process may also be applied.

The nozzle failure analyzing step NFA is applied and delivers the three digital matrices F2, F2*a*, F2*b*.

On the original digital matrix F1, the third halftoning step HT3 is applied. From the third halftoning step HT3, a digital matrix F2 is outputted, having three columns comprising halftone values 0 and 1. The nozzle failure analyzing step NFA is applied on the digital matrix F2 and delivers the three digital matrices F2*aa*, F22, F2*bb*.

A first arrow indicated by L leads to the correcting values in the three columns in the first additional digital matrix F2*aa*. The shown entries of the first additional digital matrix F2*aa* are determined by the nozzle failure analyzing step NFA. The three shown columns 64, 65, 66 of F2*aa* have halftone values 0, 1 and 2.

A second arrow indicated by R leads to the correcting values in the three columns in the second additional digital matrix F2*bb*. The shown entries of the second additional digital matrix F2*bb* are determined by the nozzle failure analyzing step NFA. The three shown columns 67, 68, 69 of F2*bb* have halftone values 0, 1 and 2.

A third arrow indicated by X leads to the values of F2 being copied into the third digital matrix F22.

Since a particular column in the digital matrix F22, except the columns on the edges of the matrix, has a left adjacent column and a right adjacent column, compensation in the form of higher values of the pixels of the left adjacent and right adjacent columns for the case that pixels of the particular column cannot be printed, will be distributed among the pixels of the left and right adjacent columns in order to achieve an appropriate gray value in a neighborhood of the pixel elements intended to be printed by the failing nozzle. This distribution may be achieved by a kind of dithering technique, a kind of error diffusion technique or any other camouflaging technique.

Figure 7:
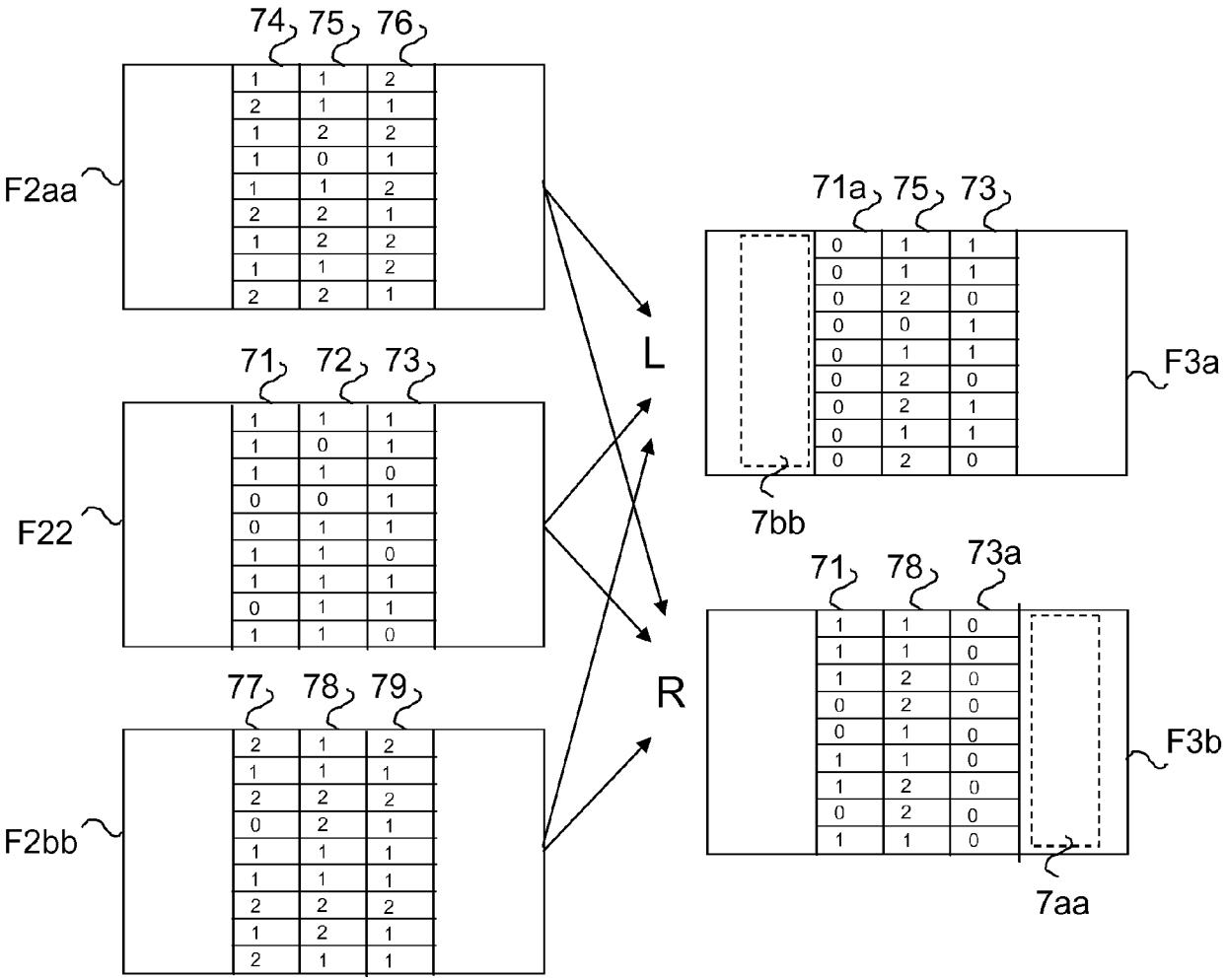
FIG. 7 shows image data during the steps executed by the merging means according to the invention, wherein the image data comprises a column which cannot be printed due to a failing nozzle and two additional digital matrices are used for replacing original image data in order to correct the failing nozzle.

FIG. 7 shows the alternative selection step on the basis of the values of the entries of the digital matrices F2*aa*, F22, F2*bb*, which are the input matrices for the alternative selection step, and on the basis of the values of the entries of the digital matrices F3*a*, F3*b*, which are two possible output matrices of the alternative selection step.

Each column 74, 75, 76 of the first additional digital matrix F2*aa* contains the replacing values 0, 1 and 2 for a column in the digital matrix F22 in case a left adjacent column is not printed due to a failing nozzle. In this case the digital matrix F22 contains only halftone values 0 and 1 and each replacing value in the columns 74, 75, 76 is greater than or equal to the corresponding value in the columns 71, 72, 73 of digital matrix F22.

Each column 77, 78, 79 of the second additional digital matrix F2*bb* contains the replacing values 0, 1 and 2 for a column in the digital matrix F22 in case a right adjacent column is not printed due to a failing nozzle. In this case, the digital matrix F22 contains only halftone values 0 and 1 and each replacing value in the columns 77, 78, 79 is greater than or equal to the corresponding value in the columns 71, 72, 73 of digital matrix F22.

In a first case L, the nozzle intended to print the left column 71 of the digital matrix F22 is failing. The values of the left column 71 of the digital matrix F22 are replaced by a column 71*a* of zeroes, since the nozzle intended to print this column is failing. The values of the middle column 72 of the digital matrix F22 are replaced by the values of the middle column 75 of the first additional digital matrix F2*aa*. The values of the right column 73 of the digital matrix F22 remain unchanged. Also, a column 7*bb* in the digital matrix F3*a* positioned left of the left column 71*a* of the digital matrix F3*a* is replaced by a column positioned left of column 77 of the digital matrix F2*bb* (not shown).

After replacing of the appropriate columns as described here-above, a digital matrix F3*a* is outputted and this digital matrix F3*a* is going to be printed by the print head 4*a*.

In a second case R, the nozzle intended to print the right column 73 of the digital matrix F22 is failing. The values of the right column 73 of the digital matrix F22 are replaced by a column 73*a* of zeroes, since the nozzle intended to print this column is failing. The values of the middle column 72 of the digital matrix F22 are replaced by the values of the middle column 78 of the second additional digital matrix F2*bb*. The values of the left column 71 of the digital matrix F22 remain unchanged. Also a column 7*aa* in the digital matrix F3*b* positioned right of the right column 73 of the digital matrix F22 is replaced by a column positioned right of column 76 of the digital matrix F2*aa* (not shown).

After replacing of the appropriate columns as described here-above, a digital matrix F3*b* is outputted and this digital matrix F3*b* is going to be printed by the print head 4*a*.

In a third case (not shown) the nozzle intended to print the middle column 72 of the digital matrix F22 is failing. The values of the middle column 72 of the digital matrix F22 are replaced by a column of zeroes since the nozzle intended to print this column is failing. The values of the left column 71 of the digital matrix F22 are replaced by the values of the left column 77 of the second additional digital matrix F2*bb*. The values of the right column 73 of the digital matrix F22 are replaced by the values of the right column 76 of the first additional digital matrix F2*aa*. After replacing of the appropriate columns as described here-above, a resulting digital matrix is going to be printed by the print head 4*a*.

Figure 8:
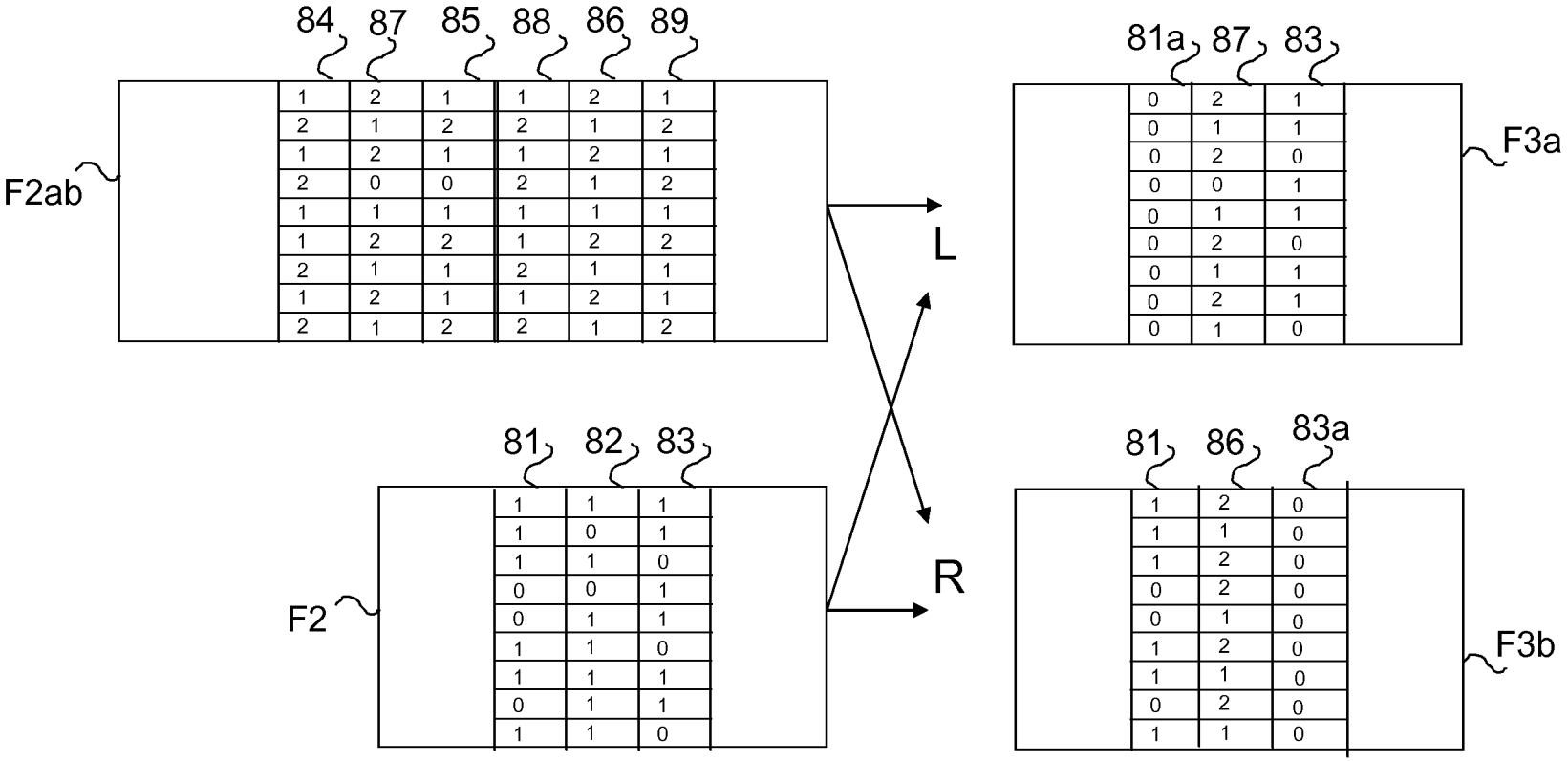
FIG. 8 shows image data during the steps executed by the merging unit according to the present invention, wherein the image data comprises a column which cannot be printed due to a failing nozzle and one additional digital matrix is used for replacing original image data in order to correct the failing nozzle.

FIG. 8 shows another embodiment of the present invention. According to the previous embodiments, two additional digital matrices F2*aa*, F2*bb* have been derived. However, the two additional digital matrices F2*aa*, F2*bb* may be combined into one single additional digital matrix F2*ab* as shown in FIG. 8. This single additional digital matrix F2*ab* comprises, for example, the columns 84, 85, 86 of the first additional digital matrix F2*aa* as shown in FIG. 7 as well as the columns 87, 88, 89 of the second additional digital matrix F2*bb* as shown in FIG. 7 in any suitable column order. FIG. 8 shows an order of columns, which alternates between the first additional digital matrix F2*aa* and the second additional digital matrix F2*bb*. This is advantageous, since a retrieval action from memory of values of a left and right neighboring column of a column that cannot be printed due to a failing nozzle, are positioned close to each other in the memory which may reduce the retrieval time.

In this way, the single additional digital matrix F2*ab* is used to create images F3*a*, F3*b*, which are actually printed by the print head 4*a*.

FIGS. 9A-9E show another embodiment of the method according to the present invention. The embodiment relates to a hybrid print strategy, which is in particular useful when printing with inkjet technology in a masking process. Such a masking process with inkjet technology may replace a well known lithography in processes such as etching, plating or sputtering, which are used for applications like the manufacturing of solar cells, lighting devices and electronic devices. The printed mask covers a receiving material and defines features to be processed. A feature may be, for example, a line element, a bar element, a rectangular element, a triangular element, a circular element or any other element of a solar cell, a lighting device or an electronic device. It is important that there is an overlap between the printed drops to reach a full coverage at positions of a feature, because a feature in a solar cell, a lighting device and an electronic device may be expected to have a conducting or isolating property.

FIG. 9A shows a high resolution bitmap 90 for printing a triangular feature 91. Each 1-bit in the high resolution bitmap 90 results in a drop on the receiving material, while each 0-bit results in no drop.

A drop is shown in FIG. 9E as a shaded circle 95. The diameter of the drop which eventually is spread on the receiving material may be twice the nozzle pitch, i.e. the distance between the middles of two adjacent nozzles.

An optimal masking feature has to be printed according to the 1-bits in the high resolution bitmap 90, which covers 100% of the triangle 91 with a least possible overlap. The bitmap 90 can be printed by nozzles in a print head with a first array A1 of nozzles n1, n3, n5, n7 and a second array A2 of nozzles n2, n4, n6, n8. The arrays A1, A2 are staggered towards each other, enabling printing according to the high resolution of the bitmap 90. Nozzles n1, n3, n5 of the first array A1 are called odd nozzles, while nozzles n2, n4 from the second array A2 are called even nozzles. According to an alternative embodiment, the image reproduction apparatus comprises two print heads, each one with one array of nozzles. The two print heads are staggered towards each other and the bitmap 90 is printed by both print heads.

FIG. 9B shows a first low resolution bitmap 92, which is printable by the even nozzles n2, n4, n6, n8 only. The first low resolution bitmap 92 covers 100% of the triangle 91 with a least possible overlap. A part of the first low resolution bitmap 92 is going to be printed when an odd nozzle is failing.

FIG. 9C shows a second low resolution bitmap 93, which is printable by the odd nozzles n1, n3, n5, n7 only. The second low resolution bitmap 93 covers 100% of the triangle 91 with a least possible overlap. A part of the second low resolution bitmap 93 is going to be printed when an even nozzle is failing.

FIG. 9D shows an application of the second low resolution bitmap 93 in case that the second even nozzle n4 is failing. The first, second, sixth, seventh and eighth column of the high resolution bitmap 90 are printed by nozzles n1, n2, n6, n7, n8, respectively. The third and fifth columns of the second low resolution bitmap 93 are printed by the second odd nozzle n3 and the third odd nozzle n5 in order to compensate the missing column of the second even nozzle n4, which is failing. In this way a hybrid pattern according to a bitmap 94 is printed, which has a resolution according to the high resolution bitmap 90 except in an area in the neighborhood of the column of the failing nozzle n4, where the resolution equals the resolution of the second low resolution bitmap 93.

Figure 10:
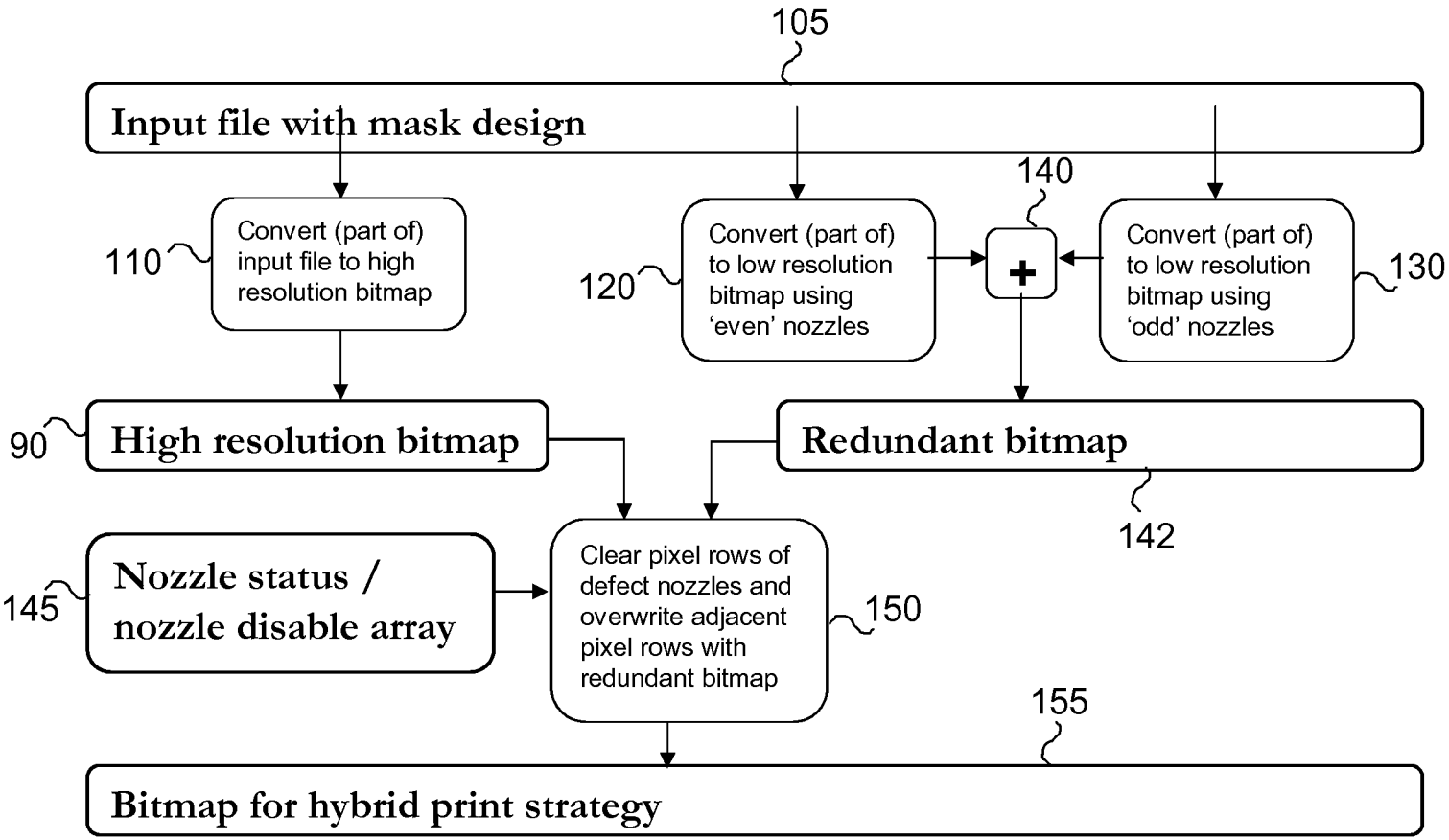
FIG. 10 shows a flow diagram of steps related to the previous embodiment according to FIGS. 9A-9E.

FIG. 10 shows a flow diagram of steps 110, 120, 130, 140, 150 related to the previous embodiment according to FIGS. 9A-9E.

In a first step 110, an input file, for example a file with a mask design, is converted to the high resolution bitmap 90.

In a second step 120, the input file is converted to the first low resolution bitmap 92.

In a third step 130, the input file is converted to the second low resolution bitmap 93.

These conversions take place before printing the high resolution bitmap 90.

There is no prescribed order of the first step 110, the second step 120 and the third step 130. Parallel processing may be applied in order to simultaneously execute the first step 110, the second step 120 and the third step 130.

In an optional fourth step 140, the first low resolution bitmap 92 and the second low resolution bitmap 93 are added to a redundant bitmap 142. The redundant bitmap 142 or, if the fourth step 140 is not applied, the first low resolution bitmap 92 and the second low resolution bitmap 93 are input for a fifth step 150.

Also input for the fifth step 150 is failing nozzle information 145. The failing nozzle information may comprise for each nozzle a nozzle status or an array of failing nozzles.

The nozzle status for a nozzle may be encoded in natural numbers 0, 1, 2, 3, . . . .

A code 0 for a nozzle may indicate that the nozzle is in a good condition and the adjacent nozzles are in a good condition. A nozzle with a code 0 is going to print the corresponding column of the high resolution bitmap 90.

A code 1 for a nozzle may indicate that the nozzle is in a good condition and at least one of the adjacent nozzles is failing. An even nozzle with a code 1 is going to print a corresponding column of the first low resolution bitmap 92. An odd nozzle with a code 1 is going to print a corresponding column of the second low resolution bitmap 93.

A code 2 for a nozzle may indicate that the nozzle is failing. A nozzle with a code 2 is not printing the corresponding column of the high resolution bitmap 90.

In the example according to FIGS. 9A-9E the nozzles n1, n2, n3, n4, n5, n6, n7, n8 will get codes 0, 0, 1, 2, 1, 0, 0, 0, respectively.

In the fifth step 150 the columns in the high resolution bitmap 90 corresponding with failing nozzles are cleared and the adjacent columns are overwritten with corresponding columns of the redundant bitmap 142. The fifth step 150 results in a bitmap 155 suitable for printing by the image reproduction apparatus.

It is noted that, by applying the steps 110-150 here-above, data of a column of the high resolution bitmap 90 corresponding to a failing nozzle is replaced by data of two columns of either the first or the second low resolution bitmap 92, 93, the two columns corresponding to the neighboring nozzles of the failing nozzle. By doing so, it is assured that the whole area included in the feature and on the boundary of the feature is covered with marking material. The printed result of the bitmap 155 has an accuracy of the high resolution bitmap 90, unless at positions of a failing nozzle, where locally a low resolution is used to ensure that the printed result is fully covering the feature.

The embodiments according to FIGS. 9A-9E and FIG. 10 are suitable for printing of metal layers by an array of metal droplet forming nozzles, for printing of metal layers by metal inks, for printing of isolation layers by isolative inks, for printing of a solder mask by heat resistant inks and for printing semi-conductive layers by semi-conductive inks.

If the reproduction apparatus according to the present invention comprises 1000 nozzles numbered from 1 to 1000 and the image comprises 1000 pixel lines, it may occur that a part of the image contains no information. For example, the image is determined for the area of nozzles numbered from 100 to 900. In this case it is not necessary to derive extra pixel arrays for the nozzles numbered from 1 to 98 and from 902 to 1000. However, to simplify the derivation of the arrays of pixels, the derivation unit may not distinguish the nozzles numbered from 99 to 901 from the other nozzles, but may derive arrays of pixels for each nozzle.

It is noted that the term marking material is used for the material, which is to be ejected on the receiving material. Marking material also includes functional material in the sense that the marking material may form drops on the receiving material, which form features on the receiving material that have a function. The function may be related to the use or purpose of the printed end product. Such a function may be, besides a marking function, an isolating function, a conducting function or any other function related to the use or purpose of the printed end product.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reproduction apparatus for printing a digital image by means of a single pass strategy, the digital image being constituted of pixels, each pixel having assigned a pixel value, said reproduction apparatus comprising:

a control unit;

a print engine, the print engine comprising print elements for ejecting an amount of marking material on a receiving material according to a pixel value; and a detector configured to detect a failing print element, wherein the control unit comprises:

a derivation unit configured to derive from the digital image, before printing of the digital image, a first matrix of columns of pixel values, wherein each pixel value of the first matrix equals a corresponding pixel value of the digital image incremented with a weight value, and a second matrix of columns of pixel values, wherein each pixel value of the second matrix equals a corresponding pixel value of the digital image incremented with a weight value; and a merging unit configured to merge the first matrix, the second matrix and the digital image, upon detection of said failing print element, for creating a corrected digital image to be printed, wherein upon detection of the failing printing element by the detection means, pixels are intended to be printed by a first printing element left neighbouring the failing printing element according to the pixel values of a column of the first matrix, and are intended to be printed by a second printing element right neighbouring the failing printing element according to the pixel values of a column of the second matrix.

2. The reproduction apparatus according to claim 1, wherein the first printing element and the second printing element are compensating print elements of the failing print element.

3. The reproduction apparatus according to claim 1, wherein the derivation unit is configured to derive the first matrix and the second matrix for each print element intended to be used for printing the image.

4. The reproduction apparatus according to claim 1, wherein the first matrix and the second matrix are redundant with respect to the digital image at a lower resolution than the digital image.

5. The reproduction apparatus according to claim 1, wherein the reproduction apparatus comprises a halftoning mechanism for halftoning the digital image after derivation of the first matrix and the second matrix from the digital image by the derivation unit.

6. The reproduction apparatus according to claim 4, wherein the reproduction apparatus comprises a halftoning mechanism for halftoning the digital image after derivation of the first matrix and the second matrix from the digital image by the derivation unit.

7. The reproduction apparatus according to claim 1, wherein the reproduction apparatus comprises a halftoning mechanism for halftoning the digital image before derivation of the first matrix and the second matrix from the digital image by the derivation unit.

8. A method for printing a digital image by a reproduction apparatus comprising a print engine which comprises print elements, where the digital image is constituted of pixels, each pixel having assigned a pixel value, the method comprising the steps of:

deriving from the digital image, before printing of the digital image, a first matrix of columns of pixel values, wherein each pixel value of the first matrix equals a corresponding pixel value of the digital image incremented with a weight value, and a second matrix of columns of pixel values, wherein each pixel value of the second matrix equals a corresponding pixel value of the digital image incremented with a weight value; and upon detection of a failing print element before or during printing, merging the first matrix, the second matrix and the digital image for creating a corrected digital image, and printing the corrected digital image, wherein upon detection of the failing printing element by the detection means, pixels are intended to be printed by a first printing element left neighbouring the failing printing element according to the pixel values of a column of the first matrix, and are intended to be printed by a second printing element right neighbouring the failing printing element according to the pixel values of a column of the second matrix.

9. A computer program embodied on a non-transitory computer readable medium and comprising computer program code to enable the reproduction apparatus according to claim 1 in order to execute a method for printing a digital image, the method comprising the steps of:

deriving from the digital image, before printing of the digital image, a first matrix of columns of pixel values, wherein each pixel value of the first matrix equals a corresponding pixel value of the digital image incremented with a weight value, and a second matrix of columns of pixel values, wherein each pixel value of the second matrix equals a corresponding pixel value of the digital image incremented with a weight value; and upon detection of a failing print element before or during printing, merging the first matrix, the second matrix and the digital image for creating a corrected digital image, and printing the corrected digital image, wherein upon detection of the failing printing element by the detection means, pixels are intended to be printed by a first printing element left neighbouring the failing printing element according to the pixel values of a column of the first matrix, and are intended to be printed by a second printing element right neighbouring the failing printing element according to the pixel values of a column of the second matrix.

* * * * *